US011103900B2

(12) United States Patent
Beyer

(10) Patent No.: US 11,103,900 B2
(45) Date of Patent: Aug. 31, 2021

(54) DRAIN SERVICING ASSEMBLY

(71) Applicant: Ken Beyer, Hamilton, MI (US)

(72) Inventor: Ken Beyer, Hamilton, MI (US)

( * ) Notice: Subject to any disclaimer, the term of this patent is extended or adjusted under 35 U.S.C. 154(b) by 0 days.

(21) Appl. No.: 15/720,474

(22) Filed: Sep. 29, 2017

(65) Prior Publication Data

US 2018/0085797 A1 Mar. 29, 2018

Related U.S. Application Data

(60) Provisional application No. 62/401,270, filed on Sep. 29, 2016.

(51) Int. Cl.

| | |
|---|---|
| ***B08B 9/02*** | (2006.01) |
| ***B08B 9/045*** | (2006.01) |
| *E03F 9/00* | (2006.01) |
| *B08B 9/047* | (2006.01) |

(52) U.S. Cl.
CPC ..... *B08B 9/045* (2013.01); *B08B 9/047* (2013.01); *E03F 9/005* (2013.01)

(58) Field of Classification Search
CPC ..... B08B 9/045; B65H 75/364
See application file for complete search history.

(56) References Cited

U.S. PATENT DOCUMENTS

| | | | | |
|---|---|---|---|---|
| 1,910,768 | A * | 5/1933 | Hotchkiss, Jr. | E03C 1/302 144/104 |
| 3,246,354 | A | 4/1966 | Cooney et al. | |
| 4,364,139 | A * | 12/1982 | Babb | E03F 9/005 15/104.33 |
| 4,580,306 | A | 4/1986 | Irwin | |
| 4,716,613 | A | 1/1988 | Irwin | |
| 4,914,775 | A | 4/1990 | Kirk | |
| 5,031,276 | A | 7/1991 | Babb et al. | |
| 5,193,242 | A | 3/1993 | Irwin | |
| 5,239,724 | A | 8/1993 | Salecker et al. | |
| 5,309,595 | A | 5/1994 | Salecker et al. | |
| 5,618,123 | A | 4/1997 | Pulse | |
| 5,640,736 | A | 6/1997 | Salecker | |
| 6,076,219 | A | 6/2000 | Irwin | |
| 6,412,136 | B1 | 7/2002 | Rutkowski | |
| 6,421,871 | B1 * | 7/2002 | Peach | B08B 9/045 15/104.05 |
| 6,618,891 | B2 | 9/2003 | Schmitt | |
| 6,760,948 | B2 | 7/2004 | Schmitt | |
| 7,055,203 | B1 * | 6/2006 | Franzino | B08B 9/0436 134/166 R |
| 7,073,224 | B2 | 7/2006 | Schmitt | |
| 7,367,077 | B2 * | 5/2008 | Rutkowski | B08B 9/045 15/104.31 |
| 7,891,038 | B2 | 2/2011 | Hale | |
| 8,176,593 | B2 | 5/2012 | Gress et al. | |
| 2008/0148503 | A1 | 6/2008 | Babb et al. | |

* cited by examiner

*Primary Examiner* — Shay Karls
(74) *Attorney, Agent, or Firm* — King & Partners, PLC

(57) ABSTRACT

A drain servicing assembly including: an outer housing; an inner containment member, wherein the inner containment member is rotatable proximate a centralized axis; a motor and/or drill secured to the inner containment member; a shaft sub-assembly in communication with the motor and/or drill that includes an outer sheath and a flexible inner shaft that is rotatable independently of the outer sheath; and a guide, wherein the guide enables a user to extract and/or retract the shaft sub-assembly.

12 Claims, 9 Drawing Sheets

DRAIN SERVICING ASSEMBLY

CROSS-REFERENCE TO RELATED APPLICATIONS

This application claims the benefit of U.S. Provisional Application Ser. No. 62/401,270, filed Sep. 29, 2016, entitled "DRAIN SERVICING ASSEMBLY," which is hereby incorporated herein by reference in its entirety—including all references and appendices cited therein.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to drain servicing assemblies and, more particularly, to a drain servicing assembly that provides a user with a clean, sanitary, and efficient way to service any one of a number of drains and associated conditions.

2. Background Art

Drain servicing assemblies and apparatuses and their sub-components have been known in the art for years, and are the subject of numerous patents, including, for example: U.S. Pat. No. 8,176,593 entitled "Drain Cleaning Apparatus with Electronic Cable Monitoring System," U.S. Pat. No. 7,891,038 entitled "Sewer Cleaning Machine," U.S. Pat. No. 6,412,136 entitled "Drain Cleaning Apparatus," U.S. Pat. No. 5,309,595 entitled "Drain Cleaning Apparatus," and U.S. Pat. No. 5,031,276 entitled "Drain Cleaning Machine," all of which are hereby incorporated herein by reference in their entirety—including all references cited therein.

U.S. Pat. No. 8,176,593 appears to disclose a drain cleaning machine with an electronic cable monitoring system which comprises a frame supporting a rotatable drum which is driven by a motor through an endless belt. The drum contains a flexible drain cleaning cable which is rotatable with the drum and axially displaceable into and out from the drum, and the frame supports a cable feeding device through which the cable extends and by which the cable is displaced into and out of the drum. An electronic cable monitoring system is configured to assess an amount of cable payed out from and retracted into the drum. A process determines an amount and direction of relative movement between a rotatable drum and a cable follower member and generates a signal representative of an amount of cable payed out or retracted into the drum.

U.S. Pat. No. 7,891,038 appears to disclose a rotary drain cleaning machine having a support structure that prevents walking of the machine when in use. The machine is supported upon two rear mounted wheels and a forward pedestal.

U.S. Pat. No. 6,412,136 appears to disclose the inner end of a snake or drain cleaning cable coiled in a rotatable cable storage drum of a drain cleaning apparatus with a torque arm which frictionally engages the outer wall of the drum to restrain sliding of the cable relative thereto during a drain cleaning operation. The drain cleaning apparatus is motor driven, and a cable feed device for axially displacing the cable relative to the storage drum is provided on the outer end of a flexible guide tube detachably mounted on the apparatus to facilitate an operator guiding the outer end of the cable into a drain to be cleaned and advancing or retracting the cable relative to the apparatus without having to physically contact the cable.

U.S. Pat. No. 5,309,595 appears to disclose a drain cleaning apparatus that has a cylindrical drum containing a supply of flexible line suitable for cleaning a drain. A frame for rotatably supporting the drum and, in addition, the frame mounts a motor for rotating the drum relative to the frame and a control unit for selectively advancing cable from the drum and causing the cable to move back into the drum as the drum and cable length are rotated in use. The apparatus includes a wheeled cart which can be connected to at least one of the frame and drum for releasably operatively connecting the cart and the one of the frame and drum to allow the cart to be used to transport the drum and frame as a unit. Alternatively, the cart is adapted to be releasably connected to the drum to allow the drum to be transported by the cart without the frame.

U.S. Pat. No. 5,031,276 appears to disclose a drain cleaning machine which comprises a frame supporting a rotatable drum that is driven by a motor through an endless belt. The drum contains a flexible drain cleaning snake which is rotatable with the drum and axially displaceable into and out of the drum, and the frame supports a snake feeding device through which the snake extends and by which the snake is displaced into and out of the drum. The frame is wheeled to facilitate transportation of the machine from one location to another. The drum, drum shaft and bearing are constructed as a unit removably mounted on the frame. The drive motor is pivotally mounted on the frame and spring biased to tension the drive belt and to facilitate separation of the drive belt from the drum to facilitate removal of the drum unit from the frame. Stabilizer members are associated with the wheels on the frame and are pivotal between storage and use positions in which the wheels respectively engage an underlying surface and are elevated above the surface to stabilize the machine against rolling and tipping displacement during use. The snake feeding device includes three rollers which engage the snake to feed the latter inwardly and outwardly of the drum in response to rotation of the drum, and two of the rollers are radially adjustable relative to the snake through corresponding cam arrangements so that the feeding device can accommodate snakes having different diameters.

While drain servicing assemblies and apparatuses and their sub-components have been known in the art for years, there is a commercial need for a drain servicing assembly that provides a user with a clean, sanitary, and efficient way to service any one of a number of drains and associated compromised conditions.

These and other objects of the present invention will become apparent in light of the present specification, claims, and drawings.

SUMMARY OF THE INVENTION

In one embodiment, the present invention is directed to a drain servicing assembly comprising, consisting essentially of, and/or consisting of: (a) a base member; (b) a cover member; (c) an inner containment member, wherein the inner containment member is secured to the base member;

(d) a motor and/or a drill secured to the inner containment member; (e) a shaft sub-assembly in communication with the motor and/or drill comprising: (1) an outer sheath; and (2) a flexible inner shaft that is rotatable independently of the outer sheath; and (f) a guide member, wherein the guide member is associated with the cover member.

In a preferred embodiment of the present invention, the base member comprises a bottom wall, a left sidewall, a right sidewall, and a rear sidewall.

In another preferred embodiment of the present invention, the base member comprises a handle associated with at least one of the bottom wall, the left sidewall, the right sidewall, and the rear sidewall, and the handle preferably includes an axle for retaining a pair of free spinning wheels.

In yet another preferred embodiment of the present invention, the inner containment member is rotatable proximate a centralized axis.

In another aspect of the present invention, the inner containment member comprises a generally circular inner sidewall and a generally circular outer sidewall.

In a preferred embodiment of the present invention, the inner containment member comprises an aperture adapted for accommodating a portion of the shaft sub-assembly.

In another preferred embodiment of the present invention, the motor and/or drill is releasably secured to the inner containment member.

In yet another preferred embodiment of the present invention, the motor and/or drill variably and rotatably actuates the flexible inner shaft of the shaft sub-assembly without rotatably actuating the outer sheath of the shaft sub-assembly.

In a preferred embodiment of the present invention, the cover member comprises a top wall and a front sidewall.

In another preferred embodiment of the present invention, the base member and the cover member cooperatively form an enclosure having a containment region therein.

In yet another preferred embodiment of the present invention, the guide member facilitates the extraction and/or retraction of the shaft sub-assembly by a user.

In a preferred embodiment of the present invention, the flexible inner shaft of the shaft sub-assembly is releasably secured to one or more of a cutting head, a functional head, a painting head, and a camera.

In one embodiment, the present invention is also directed to a drain servicing assembly comprising, consisting essentially of, and/or consisting of: (a) a base member, wherein the base member comprises a bottom wall, a left sidewall, a right sidewall, and a rear sidewall, wherein the base member comprises a handle associated with at least one of the bottom wall, the left sidewall, the right sidewall, and the rear sidewall, and wherein the handle includes an axle for retaining a pair of free spinning wheels; (b) a cover member, wherein the cover member comprises a top wall and a front sidewall, and wherein the base member and the cover member cooperatively form an enclosure having a containment region therein; (c) an inner containment member, wherein the inner containment member is secured to the base member and rotatable proximate a centralized axis, wherein the inner containment member comprises a generally circular inner sidewall and a generally circular outer sidewall, and wherein the inner containment member comprises an aperture adapted for accommodating a portion of a shaft sub-assembly; (d) at least one of a motor and a drill secured to the inner containment member, wherein the at least one motor and drill is releasably secured to the inner containment member, and wherein the at least one motor and drill variably and rotatably actuates a flexible inner shaft of a shaft sub-assembly without rotatably actuating an outer sheath of a shaft sub-assembly; (e) a shaft sub-assembly in communication with the at least one motor and drill comprising: (1) an outer sheath; and (2) a flexible inner shaft that is rotatable independently of the outer sheath, wherein the flexible inner shaft of the shaft sub-assembly is in communication with one or more of a cutting head, a functional head, a painting head, and a camera; and (f) a guide member, wherein the guide member is associated with the cover member, and wherein the guide member facilitates the extraction and/or retraction of the shaft sub-assembly by a user.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be further understood that the invention is not necessarily limited to the particular embodiments illustrated herein.

The invention will now be described with reference to the drawings wherein.

DETAILED DESCRIPTION OF THE INVENTION

Figure 1:
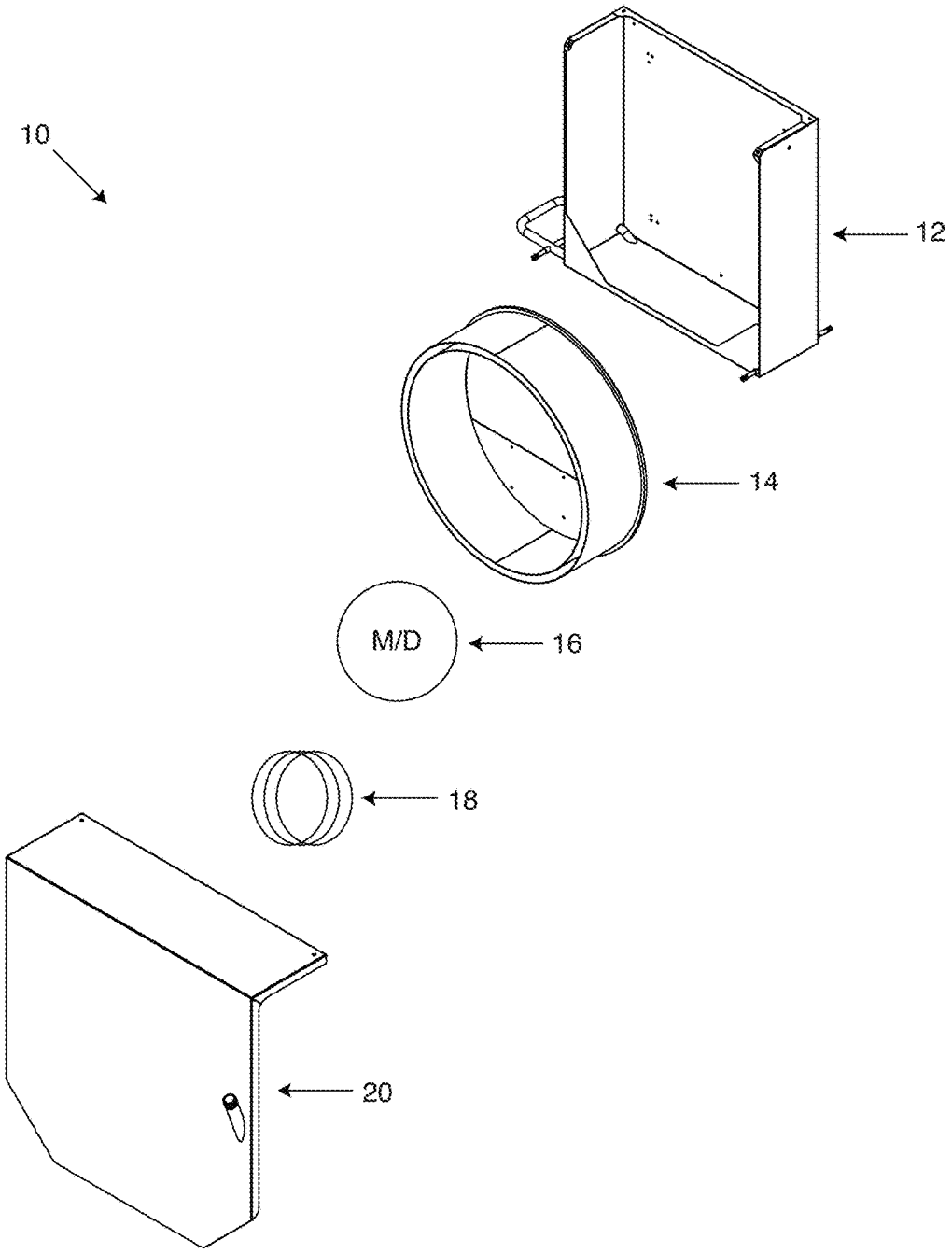
FIG. 1 is an exploded perspective view of a drain servicing assembly fabricated in accordance with the present invention.

While this invention is susceptible of embodiment in many different forms, there is shown in the drawings and will be described herein in detail, one or more specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIG. 1 in particular, drain servicing assembly 10 is shown as generally comprising base member 12, inner containment member 14, motor/drill 16, shaft sub-assembly 18, and cover member 20. In accordance with the present invention, drain servicing assembly 10 is configured to provide a user with a clean, sanitary, and efficient way to service any one of a number of drains and associated compromised conditions.

Figure 2:
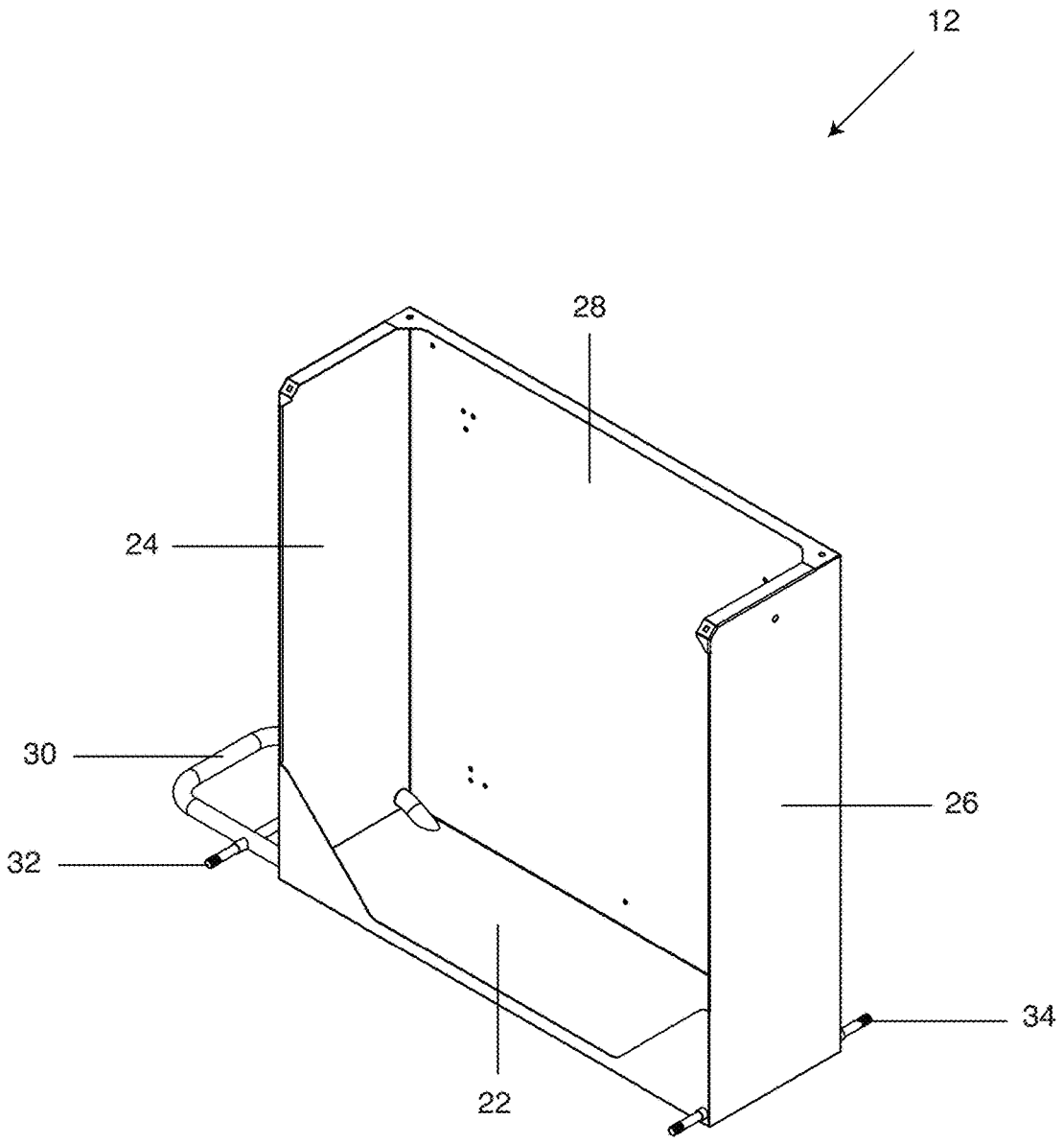
FIG. 2 is a perspective view of a base member of a drain servicing assembly fabricated in accordance with the present invention.
Figure 9:
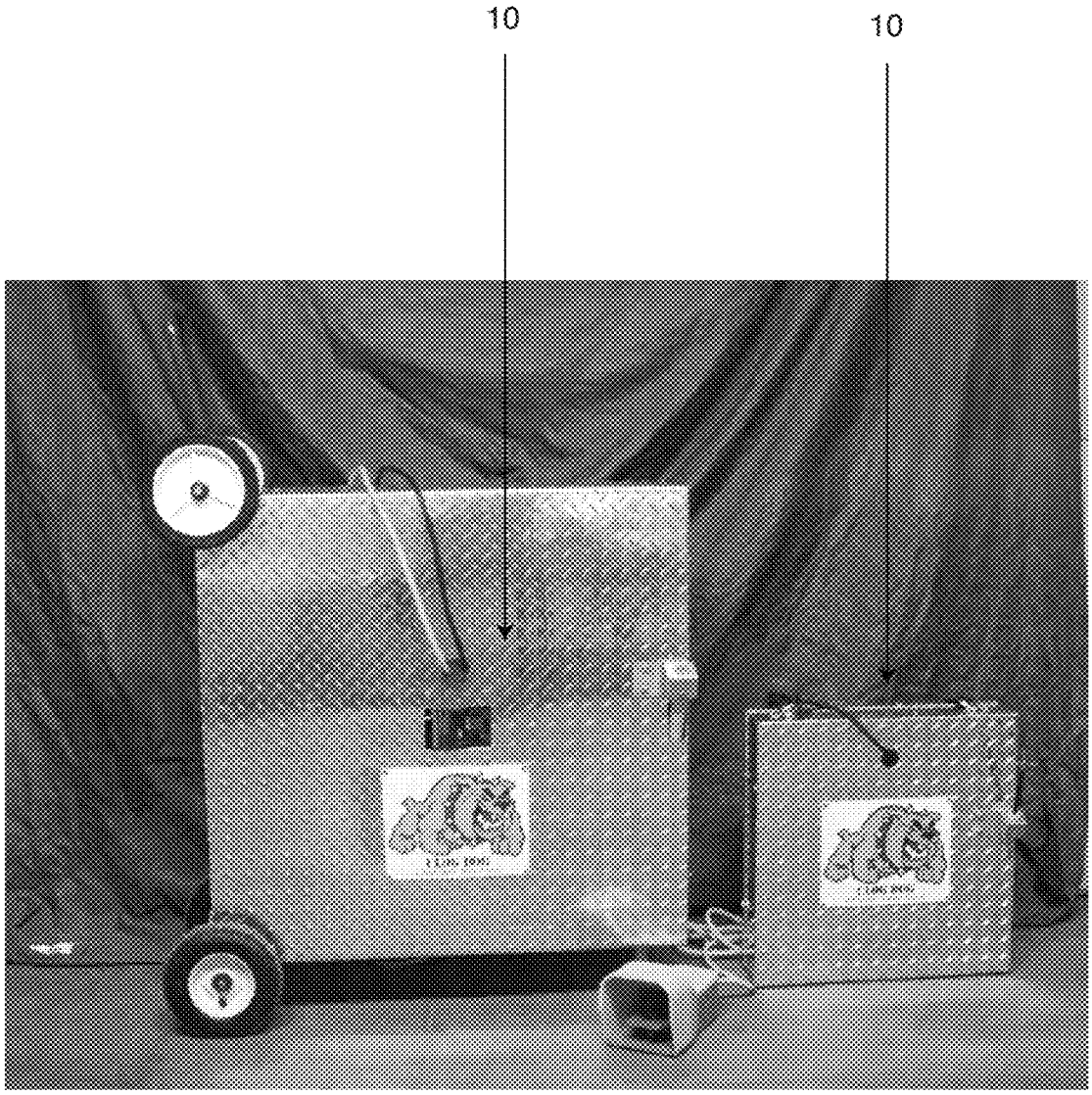
FIG. 9 are perspective views of drain servicing assemblies fabricated in accordance with the present invention.

As is best shown in FIG. 2, base member 12 generally includes bottom wall 22, left sidewall 24, right sidewall 26, and rear sidewall 28. In certain embodiments, base member 12 may include handle 30 which optionally includes axle 32 for retaining a pair of free spinning wheels (See FIG. 9). Base member 12 may also include axle 34 for retaining an additional pair of free spinning wheels (See FIG. 9).

Base member 12 is preferably fabricated from, for example, metals (e.g. aluminum, tin, copper, nickel, titanium, steel, and alloys thereof), natural resins, synthetic resins, plastics, composites, woods, and mixtures thereof. In one embodiment, base member 12 is at least partially coated (e.g., dip coated, spin coated, brush coated and/or spray coated—including, but not limited to, cold spraying, thermal spraying, high velocity spraying (e.g., supersonic), low velocity spraying (e.g., subsonic), triboelectric discharge kinetic spraying and other similar processes) with at least one overcoat material selected from the group consisting of a natural polyisoprene, a synthetic polyisoprene, a polybutadiene, a chloroprene rubber, a butyl rubber, a halogenated butyl rubber, a styrene-butadiene rubber, a nitrile rubber, a hydrogenated nitrile rubber, an ethylene propylene rubber, an ethylene propylene diene rubber, an epichlorohydrin rubber, a polyacrylic rubber, a silicone rubber, a fluorosilicone rubber, a fluoroelastomer, a perfluoroelastomer, a polyether block amide, a chlorosulfonated, ethylene-vinyl acetate, a resilin, an elastin, a polysulfide rubber, an elastolefin, and combinations thereof.

In accordance with the present invention, base member 12 may be associated with one or more anti-microbial, anti-bacterial, and/or anti-viral agents.

Suitable anti-microbial agents comprise chemical compositions that at least substantially inhibit microbial growth and/or kill bacteria, fungi and/or other microorganisms. A plurality of inorganic and/or organic chemical compositions which display anti-microbial activity are suitable for use with the present invention. Non-limiting examples of suitable organic substances that possess anti-microbial activity are carboxylic acids, alcohols and/or aldehydes, most of which appear to act by protein precipitation and/or by disruption of microbial cell membrane.

In one embodiment of the present invention, the anti-microbial activity of suitable inorganic substances is generally related to the ions, toxic to other microorganisms, into which they dissociate. The anti-microbial activity of various metal ions, for example, is often attributed to their affinity for protein material and the insolubility of the metal proteinate formed. Metal-containing salts are thus preferred among the inorganic substances that act as anti-microbial agents.

Metal inorganic salts, including simple salts of metal cations and inorganic anions like silver nitrate, are often soluble and dissociable and, hence, offer ready availability of potentially toxic ions.

Metal salts or complexes of organic moieties such as organic acids, on the other hand, are often less soluble and, therefore, are less dissociable than the soluble metal inorganic salts. Metal organic salts or complexes generally have a greater stability with respect to extraneous organic matter, and anions present in the environment of the living cell than metal inorganic salts, but have less toxic potential by virtue of their greater stability.

Silver ion is an example of a preferred metal ion which possess anti-microbial activity. To the best of Applicant's knowledge silver ions react with a variety of anions as well as with chemical moieties of proteins. Precipitation of proteins, causing disruption of the microbial cell membrane and complexation with DNA, is likely the basis of the anti-microbial activity. Silver ions in high concentration will form insoluble silver chloride and thereby deplete chloride ions in vivo.

Anti-bacterial agents are preferably antiseptics that have the proven ability to act against bacteria. Non-limiting examples of anti-bacterials suitable for use in accordance with the present invention include alcohols such as ethanol (20-99$^{+}$%), 1-propanol (20-99$^{+}$%) and 2-propanol/isopropanol (20-99$^{+}$%) or mixtures of these alcohols. They are commonly referred to as "surgical alcohol". Used to disinfect an area, often along with iodine (tincture of iodine) or some cationic surfactants (benzalkonium chloride 0.05-0.5%, chlorhexidine 0.2-4.0% or octenidine dihydrochloride 0.1-2.0%). Other common anti-bacterials include quaternary ammonium compounds known as Quats or QAC's, include the chemicals benzalkonium chloride (BAC), cetyl trimethylammonium bromide (CTMB), cetylpyridinium chloride (Cetrim, CPC) and benzethonium chloride (BZT). Benzalkonium chloride is used in some pre-operative skin disinfectants (conc. 0.05-0.5%) and antiseptic towels. The anti-microbial activity of Quats is inactivated by anionic surfactants, such as soaps. Related disinfectants include chlorhexidine and octenidine.

It will be understood that base member 12 and/or any other component of drain servicing assembly 10, including any overcoat layer, may be single or double sidedly dip or spray coated with the anti-microbial, anti-bacterial, and/or anti-viral agents, or alternatively the components may be impregnated with one or more of the aforementioned agents.

Figure 3:
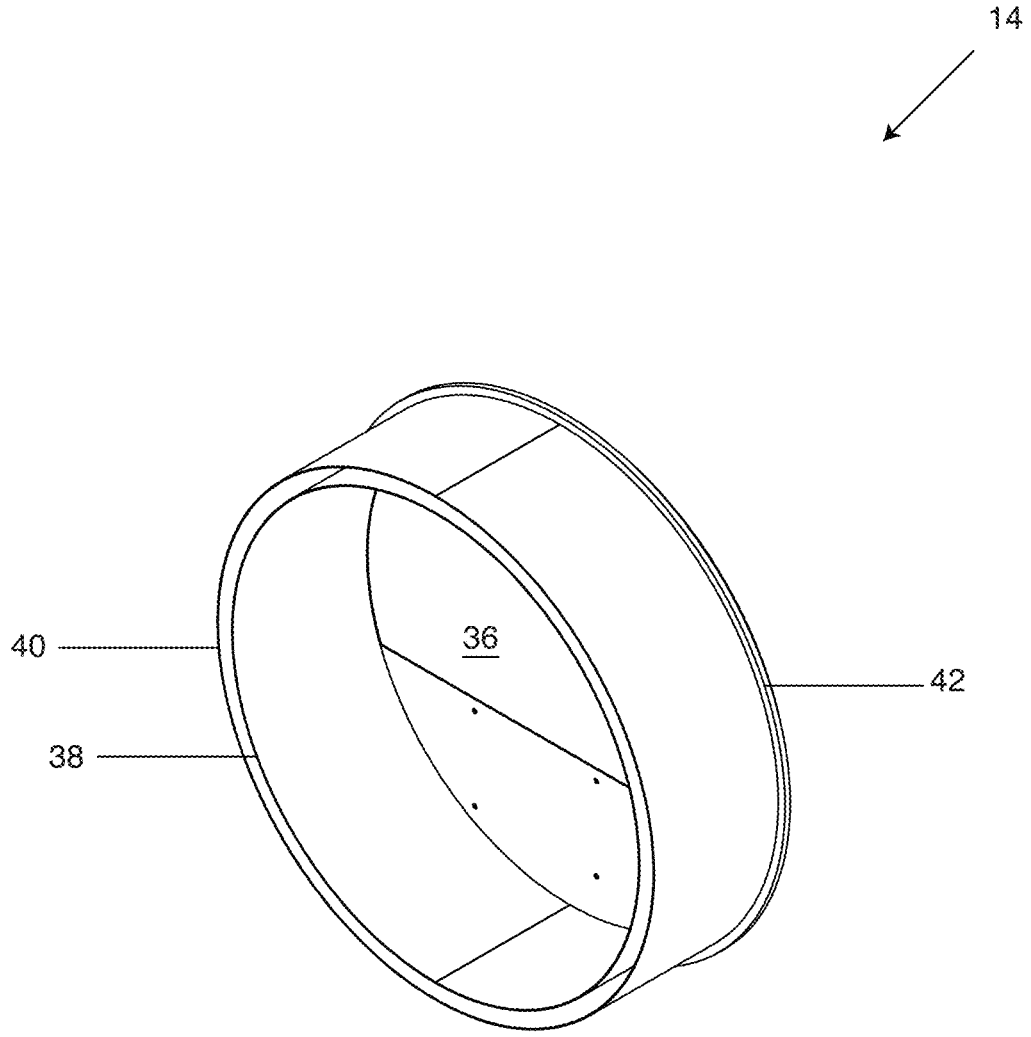
FIG. 3 is a perspective view of an inner containment member of a drain servicing assembly fabricated in accordance with the present invention.

Referring now to FIG. 3, inner containment member 14 generally includes rear wall 36, substantially circular inner sidewall 38, and substantially circular outer sidewall 40, and lip/flange 42. Inner containment member 14 may include slot/aperture 44 (See FIGS. 4 and 5) which is adapted to accommodate a portion of the shaft sub-assembly. Inner containment member 14 is secured to base member 12 via conventional fasteners, and freely rotatable proximate a centralized axis.

Inner containment member 14 is preferably fabricated from, for example, metals (e.g. aluminum, tin, copper, nickel, titanium, steel, and alloys thereof), natural resins, synthetic resins, plastics, composites, woods, and mixtures thereof. Inner containment member 14 may also be associated with one or more overcoat materials and/or one or more anti-microbial, anti-bacterial, and/or anti-viral agents as disclosed supra.

Figure 4:
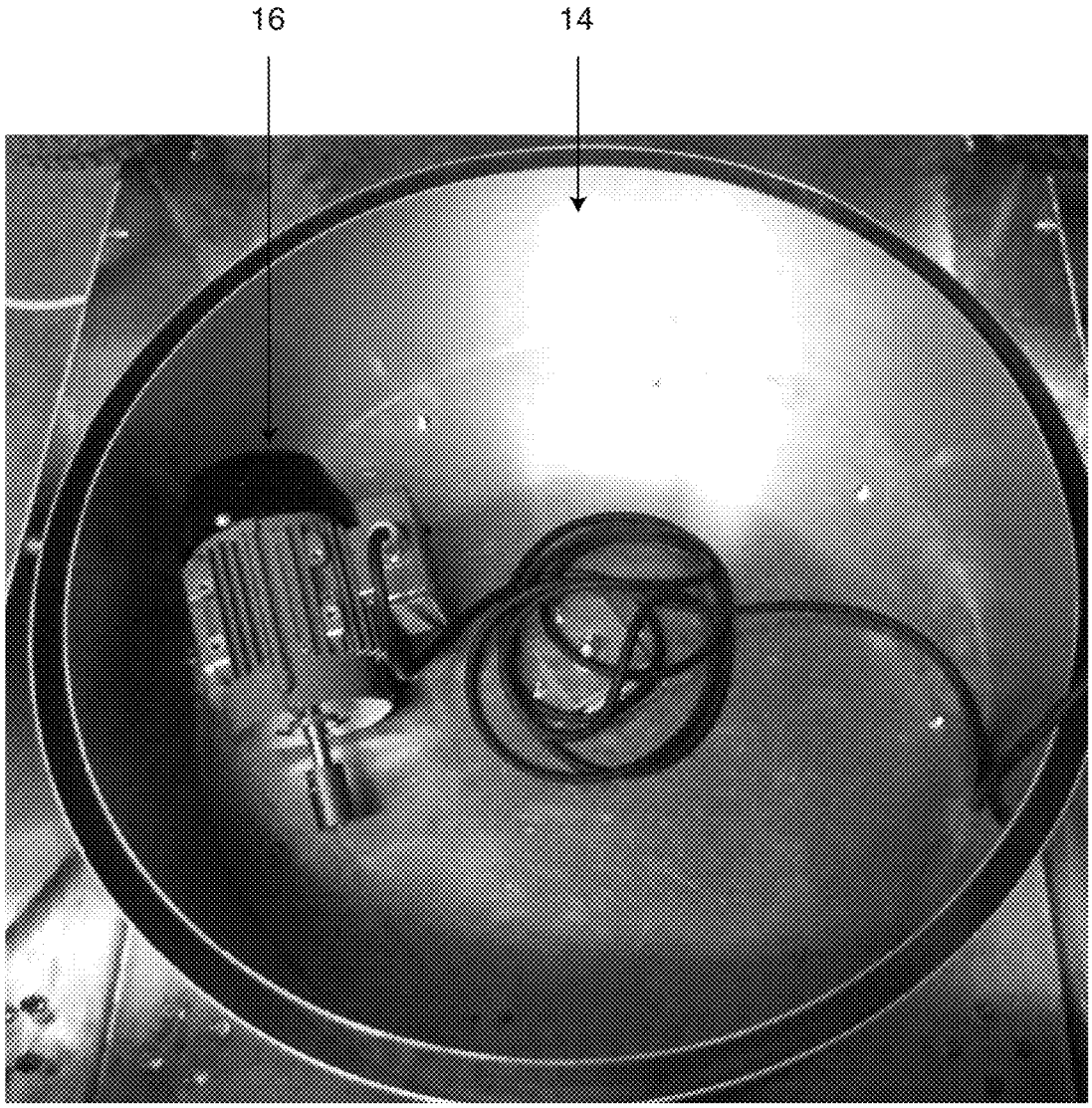
FIG. 4 is a perspective view of an electric motor secured to an inner containment member of a drain servicing assembly fabricated in accordance with the present invention.
Figure 5:
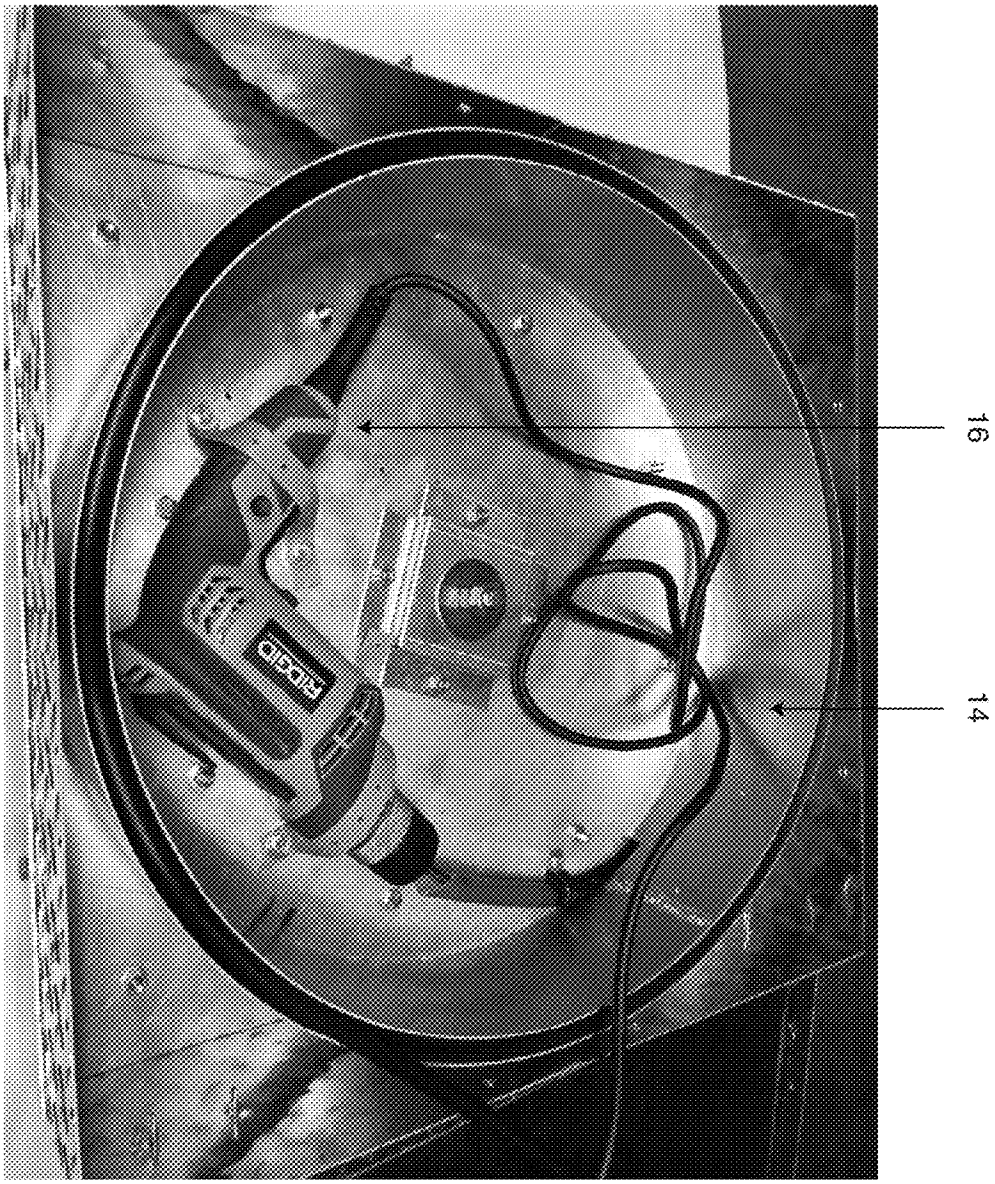
FIG. 5 is a perspective view of an electric drill secured to an inner containment member of a drain servicing assembly fabricated in accordance with the present invention.

Referring now to FIGS. 4 and 5, motor 16 (FIG. 4) and/or drill 16 are preferably secured to sidewall 36 of inner containment member 14. As will be discussed in greater detail below, motor/drill 16 variably and rotatably actuates the flexible inner shaft of shaft sub-assembly 18 without rotatably actuating the outer sheath of shaft sub-assembly 18. In accordance with the present invention, motor/drill 16 may be AC and/or DC powered and are commercially available at conventional hardware and electrical supply stores.

Figure 6:
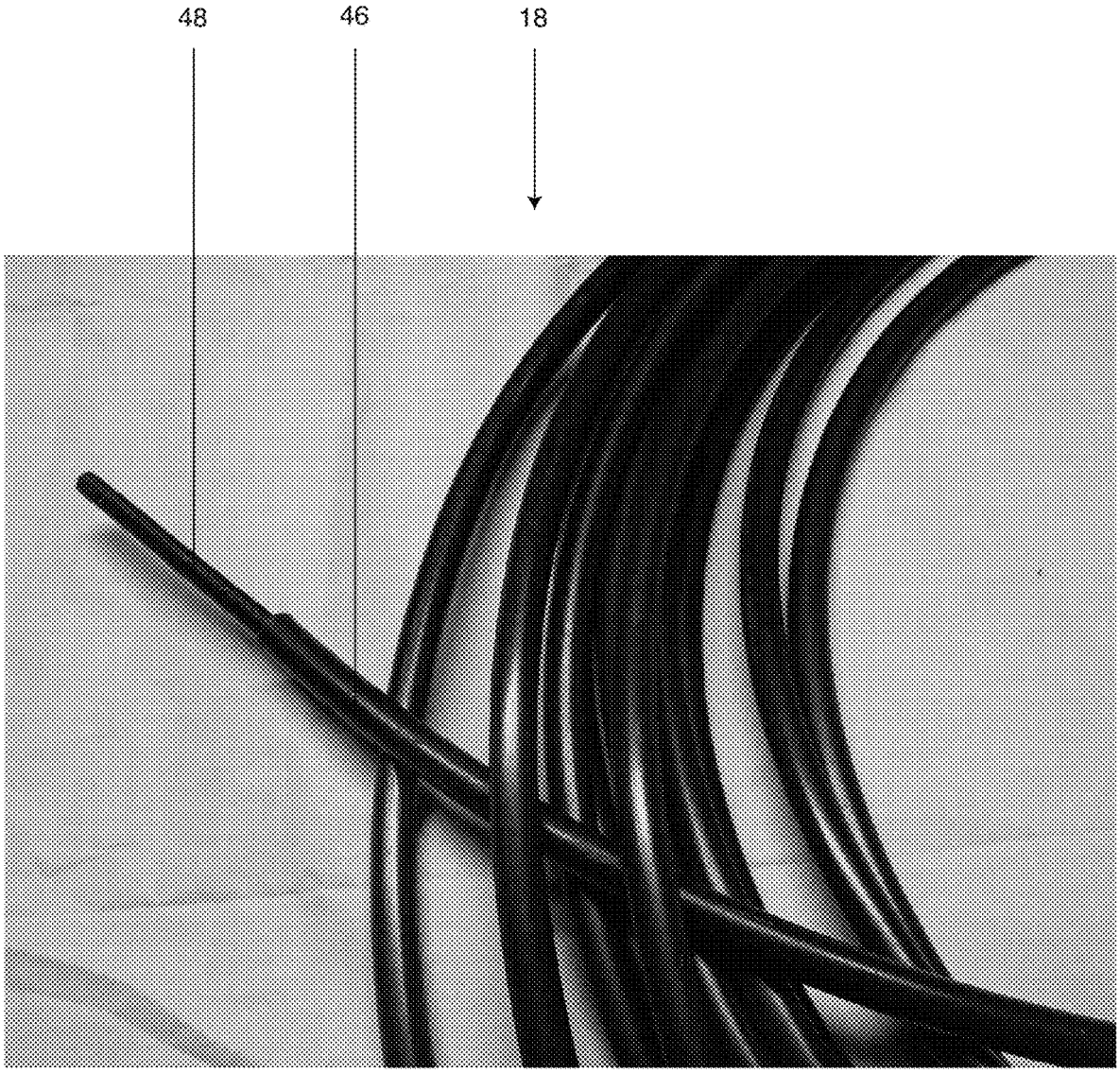
FIG. 6 is a perspective view of a shaft sub-assembly of a drain servicing assembly fabricated in accordance with the present invention.
Figure 7:
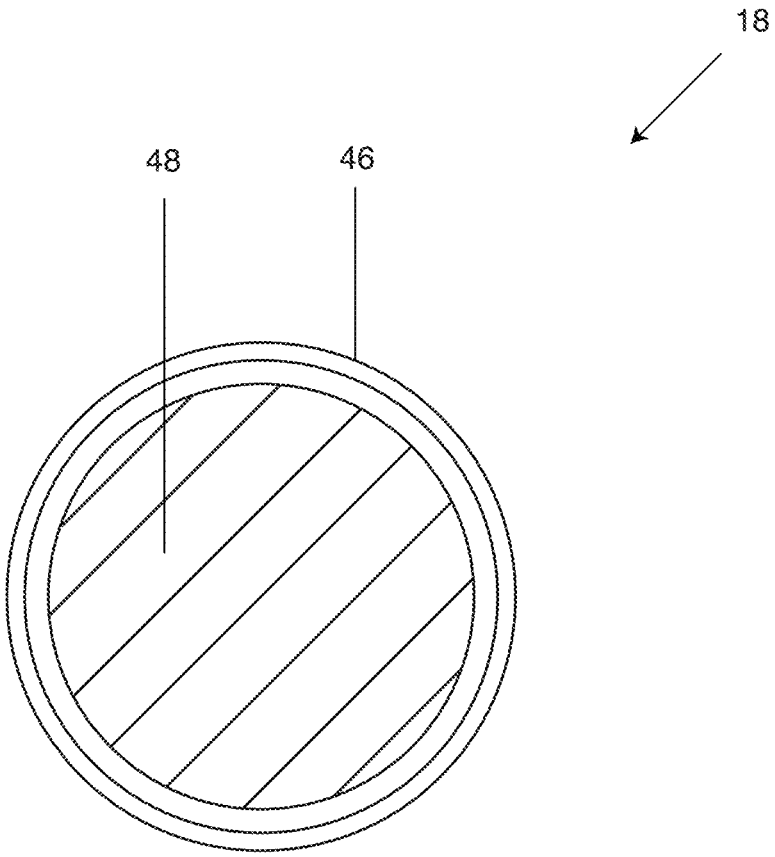
FIG. 7 is a cross sectional view of a shaft sub-assembly of a drain servicing assembly fabricated in accordance with the present invention.

Referring now to FIGS. 6 and 7, shaft sub-assembly 18 generally includes outer sheath 46 and inner shaft 48. Inner shaft 48 is preferably rotatable independently of outer sheath 46. On a first end, inner shaft 48 is releasably coupled to and in mechanical communication with the motor/drill 16, and on a second end, inner shaft 48 is releasably coupled to and in mechanical communication with a cutting head, a functional head, a painting head, a camera, etcetera. Outer sheath 46 and inner shaft 48 are both preferably sufficiently flexible to be wound into inner containment member 14, as well as displaced throughout conventional household supply lines, drains, plumbing, etcetera.

Outer sheath 46 and inner shaft 48 are both preferably fabricated from, for example, metals (e.g. aluminum, tin, copper, nickel, titanium, steel, and alloys thereof), natural resins, synthetic resins, plastics, composites, woods, and mixtures thereof. Outer sheath 46 and/or inner shaft 48 may also be associated with one or more overcoat materials and/or one or more anti-microbial, anti-bacterial, and/or anti-viral agents as disclosed supra.

Figure 8:
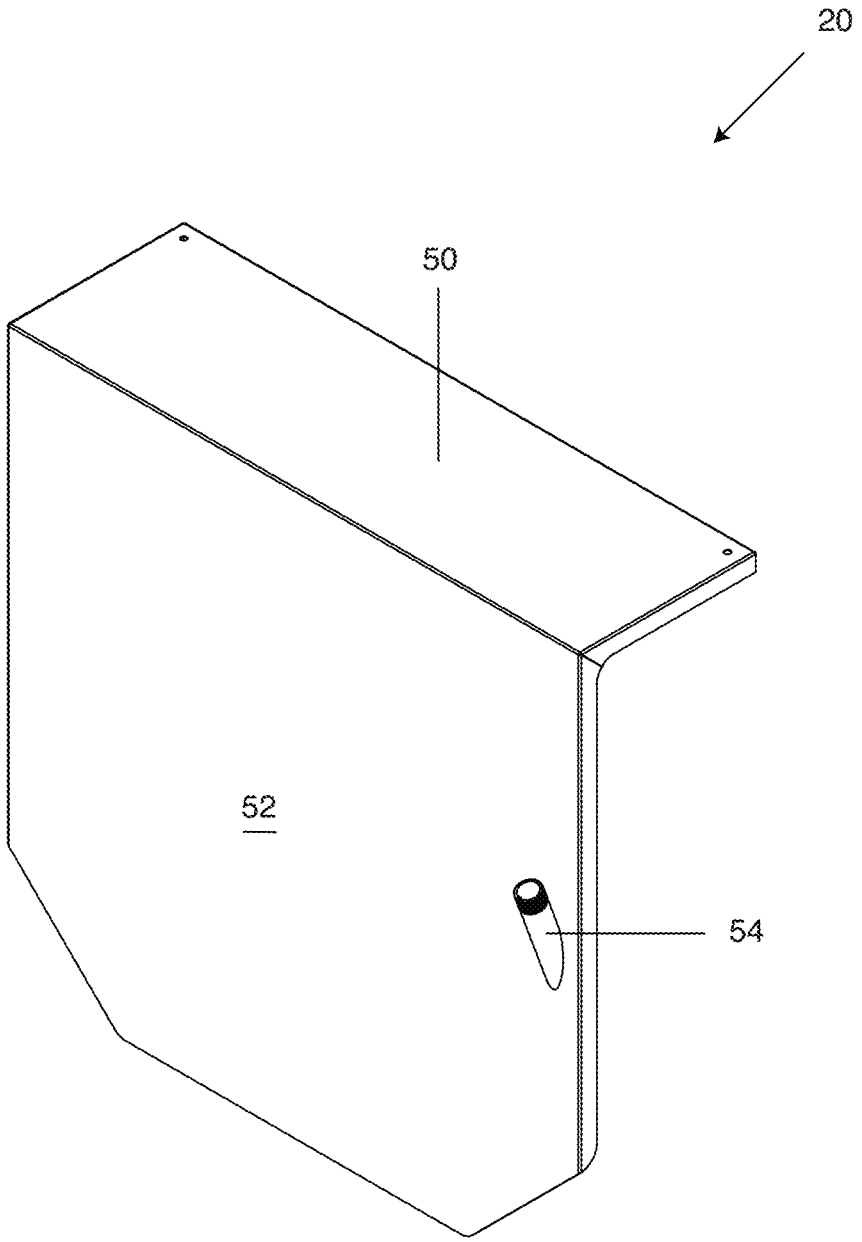
FIG. 8 is a perspective view of a cover member of a drain servicing assembly fabricated in accordance with the present invention.

Referring now to FIG. 8, cover member 20 generally includes top wall 50 and front sidewall 52. It will be understood that base member 12 and cover member 20 cooperatively form an enclosure having a containment region therein for containing inner containment member 14, motor/drill 16, and shaft sub-assembly 18. Cover member 20 also preferably includes guide member 54. Guide member 54 facilitates the extraction and/or retraction of shaft sub-assembly 18 by a user.

Cover member 20 and guide member 54 are preferably fabricated from, for example, metals (e.g. aluminum, tin, copper, nickel, titanium, steel, and alloys thereof), natural resins, synthetic resins, plastics, composites, woods, and mixtures thereof. Cover member 20 and guide member 54 may also be associated with one or more overcoat materials and/or one or more anti-microbial, anti-bacterial, and/or anti-viral agents as disclosed supra.

In operation a user deploys drain servicing assembly 10 to a location with, for example, a clogged drain. Shaft sub-assembly 18 is fitted with a cutting head, a functional head, a painting head, and/or a camera—depending on the situation. Shaft sub-assembly 18 is pulled out of inner containment member 14 via rotational displacement in a controlled manner in cooperation with guide member 54. The user may then actuate, for example, a cutting head remotely with motor/drill 16 to resolve the problem/situation without spraying any portion of the location with debris from the shaft. Once the problem/situation is resolved, shaft sub-assembly 18 can be washed by a user and quickly retracted into inner containment member 14.

The foregoing description merely explains and illustrates the invention and the invention is not limited thereto except insofar as the appended claims are so limited, as those skilled in the art who have the disclosure before them will be able to make modifications without departing the scope of the invention.

What is claimed and desired to be secured by Letters Patent of the United States is:

1. A drain servicing assembly, comprising:

a base member defining a back wall, a bottom wall extending from an end portion of the back wall, and a pair of sidewalls respectively extending from spaced-apart end portions of the back wall and spaced-apart end portions of the bottom wall;

a cover member defining a top wall, wherein the back wall, spaced-apart pair of sidewalls, top wall and bottom wall together define a hollow region;

an inner containment member, wherein the inner containment member is removably secured to the base member;

a drill removably secured to the inner containment member and contained within the hollow region;

a shaft sub-assembly disposed in the hollow region and operatively associated with a rotatable component of the drill, wherein the shaft sub-assembly comprises:

a hollow sheath, wherein the sheath includes an inner surface and an outer surface; and a flexible inner shaft disposed within the sheath, wherein the flexible inner shaft includes an exterior surface, wherein the exterior surface of the flexible inner shaft is spaced from the inner surface of the sheath during normal use, and wherein the flexible inner shaft is rotatable independently of the sheath, wherein at least a portion of the sheath and the flexible inner shaft are adapted for removable insertion into an inside of a drain in need of servicing; and wherein the cover member includes a guide member for facilitating extraction and/or retraction of at least a portion of the shaft sub-assembly from the hollow region.

2. The drain servicing assembly according to claim 1, wherein the base member includes a handle associated with at least one of the bottom wall, the back wall, and at least one of the pair of sidewalls.

3. The drain servicing assembly according to claim 2, wherein the handle includes an axle for retaining a pair of free spinning wheels.

4. The drain servicing assembly according to claim 1, wherein the inner containment member is rotatable proximate a centralized axis.

5. The drain servicing assembly according to claim 4, wherein the inner containment member comprises a generally circular inner sidewall and a generally circular outer sidewall.

6. The drain servicing assembly according to claim 5, wherein the inner containment member defines an aperture adapted for accommodating a portion of the shaft sub-assembly.

7. The drain servicing assembly according to claim 6, wherein the drill is releasably secured to the inner containment member.

8. The drain servicing assembly according to claim 7, wherein the drill variably and rotatably actuates the flexible inner shaft of the shaft sub-assembly without rotatably actuating the outer sheath of the shaft sub-assembly.

9. The drain servicing assembly according to claim 1, wherein the cover member further includes a front sidewall.

10. The drain servicing assembly according to claim 1, wherein the flexible inner shaft of the shaft sub-assembly is operatively associated with one or more of a cutting head, a functional head, a painting head, and a camera.

11. The drain servicing assembly according to claim 10, wherein the flexible inner shaft of the shaft sub-assembly is releasably secured to one or more of a cutting head, a functional head, a painting head, and a camera.

12. A drain servicing assembly, comprising:

a base member, wherein the base member comprises a bottom wall, a left sidewall, a right sidewall, and a rear sidewall, wherein the base member includes a handle associated with at least one of the bottom wall, the left sidewall, the right sidewall, and the rear sidewall, and wherein the handle includes an axle configured for retaining at least one free spinning wheel;

a cover member, wherein the cover member includes a top wall and a front sidewall, and wherein the base member and the cover member when spaced closely provide an enclosure having a containment region therein;

an inner containment member, wherein the inner containment member is releasably secured to the base member and rotatable proximate a centralized axis, wherein the inner containment member comprises a generally circular inner sidewall and a generally circular outer sidewall, and wherein the inner containment member defines an aperture adapted for accommodating at least a portion of a shaft sub-assembly;

a drill releasably secured within the containment region to the inner containment member;

a wherein the shaft sub-assembly is disposed in the containment region and operatively associated with the drill, wherein the shaft sub-assembly comprises:

an outer sheath; and a flexible inner shaft that is rotatable independently of the outer sheath, wherein the flexible inner shaft of the shaft sub-assembly is operatively associated with one or more of a cutting head, a functional head, a painting head, and a camera; and a guide member, wherein the guide member is associated with the cover member, and wherein the guide member facilitates the extraction and/or retraction of at least an end portion of the shaft sub-assembly from the containment region by a user.

* * * * *